United States Patent [19]

Clasen et al.

[11] 4,258,114

[45] Mar. 24, 1981

[54] ELECTROPHOTOGRAPHIC RECORDING MATERIAL AND METHOD OF MANUFACTURING SAME

[75] Inventors: Rolf Clasen; Hans G. Junginger, both of Aachen, Fed. Rep. of Germany

[73] Assignee: U.S. Philips Corporation, New York, N.Y.

[21] Appl. No.: 31,896

[22] Filed: Apr. 20, 1979

[30] Foreign Application Priority Data

May 10, 1978 [DE] Fed. Rep. of Germany ..... 2820302

[51] Int. Cl.[3] ..... G03G 5/04

[52] U.S. Cl. ..... 430/67; 430/66; 430/132; 430/133; 430/135; 430/56

[58] Field of Search ..... 430/56, 66, 67, 132, 430/135, 133, 57, 69, 84; 252/62.3 R

[56] References Cited

U.S. PATENT DOCUMENTS

| | | | |
|---|---|---|---|
| 3,830,648 | 8/1974 | Rutherford | 430/67 |
| 3,950,167 | 4/1976 | Tutihasi | 430/56 |
| 4,049,448 | 9/1977 | Honjo | 430/66 |
| 4,121,933 | 10/1978 | Dannert | 430/84 |

FOREIGN PATENT DOCUMENTS

| | | | |
|---|---|---|---|
| 40-28500 | 12/1965 | Japan | 430/56 |
| 50-34234 | 4/1975 | Japan | 430/67 |
| 51-16146 | 5/1976 | Japan | 430/66 |
| 826739 | 1/1960 | United Kingdom | 430/56 |
| 1199061 | 7/1970 | United Kingdom | 430/56 |

OTHER PUBLICATIONS

Xerox Disclosure Journal, vol. 1, No. 2, Feb. 1976, "Photo-Ion Transport System" by J. B. Wells.

*Primary Examiner*—Mary F. Downey

*Attorney, Agent, or Firm*—Thomas A. Briody; Robert T. Mayer; Jack E. Haken

[57] ABSTRACT

An electrophotographic recording material having a porous layer of photoconductor-binder, particularly with crystalline tetragonal lead monoxide as the photoconductor, is provided between an electrically conductive layer and a dielectric foil, said pores of the layer of photoconductor-binder, prior to providing the foil, being filled with a high-ohmic dielectric liquid to wet both the layer of photoconductor-binder and the foil. Preferably, the pores of the layer are filled with tetramethyl tin as the photoconductor-binder. As a result of this, the use of an adhesive between the foil and the layer of photoconductor-binder may be omitted. A large porosity and hence a great sensitivity of the layer of photoconductor-binder are maintained.

15 Claims, 1 Drawing Figure

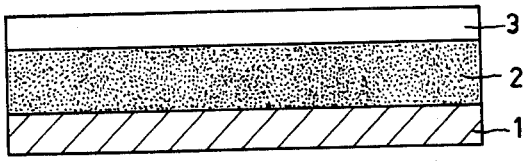
3
2
1

ELECTROPHOTOGRAPHIC RECORDING MATERIAL AND METHOD OF MANUFACTURING SAME

The invention relates to an electrophotographic recording material having a porous layer of photoconductor-binder which is provided between an electrically conductive layer and a dielectric foil. The invention furthermore relates to a method of manufacturing such a recording material in which the dielectric foil and the layer of photoconductor-binder are laid one on top of the other.

A number of recording methods have become known of late in electrophotography in which a recording material is used which consists of several layers. In contrast with xerography, in which the picture-forming layer must simultaneously store also the charge image, these functions may be divided and the layers be optimized in the case of several layers. In a simple multilayer system a dielectric foil is present on a photoconductive layer, for example, a layer of photoconductor-binder, which foil can capacitively store the charge carriers generated in the photoconductor by pictorial irradiation with a built-up electric field. As a result of this, very sensitive substances with larger dark conduction may also be used as photoconductors. Because the development of the charge image can take place on the upper side of the dielectric foil, it is also possible to use porous layers of photoconductive-binder. Upon uniting the porous layers with the foils, however, problems present themselves.

In German Auslegeschrift No. 21 45 112 it is stated that electrophotographic recording materials are known from German Offenlegungsschrift No. 15 72 344, which materials contain an electrically insulating and a photoconductive layer bonded on the one hand to the strongly insulating layer and on the other hand to an electrically conductive layer as one assembly. Latent images are generated on the surface of the electrically insulating layer. The problem of the porosity of the photoconductive layer upon providing the electrically insulating layer does not form the subject matter of the German Auslegeschrift No. 21 45 112.

According to German Offenlegungsschrift No. 15 72 344, the electrophotographic recording materials are manufactured in that orthorhombic lead monoxide as a photoconductor in the form of particles having a particle size in the range between 0.25 and 10 μm is dispersed in a solution of an insulating binder. The suspension is provided on an electrically conductive layer as a substratum. The solvent is evaporated in air, that is to say dried, and a layer of photoconductive material remains on the substratum. The weight ratio between lead monoxide and resin as a binder may vary between 1:1 and 16:1 in the photoconductive layer. A hard smooth material, for example, a wax, is provided on the surface of the photoconductive layer as an electrically insulating layer. As a result of this, the recording material may be used again up to 100 times. After the manufacture of the hard layer the recording material must be subjected to a thermal treatment if photosensitivities necessary for medical X-ray radiation are to be obtained. It is also not stated in German Offenlegungsschrift No. 15 72 344 that the provision of a hard smooth layer on the photoconductive layer presents problems if the photoconductive layer is porous.

These problems form the subject of the German Offenlegungsschrift No. 19 56 166 from which a method is known of manufacturing an electrophotographic recording material having a layer support, a photoconductive layer and an insulating covering layer, the insulating covering layer being pressed on the photoconductive layer. Various methods of manufacturing photosensitive elements for electrophotography are mentioned by providing an insulating covering layer and an insulating layer, respectively, on a photoconductive layer and a photoresistive layer, respectively. For example, the insulating layer may simply be provided on the surface of a photoresistive layer. So only two layers are laid one on top of the other so that the formation of an uneven surface and hence bubbles and pleats is possible. In another method, the insulating layer may be brought in intimate contact with the photoresistive layer and be adhered by means of an adhesive resin binder present in the photoresistive layer. The physical properties of the photoresistive layer are strongly influenced by the choice of the binder. Many disadvantages arise especially when a small quantity of binder is used. For example, if the photoresistive layer has a porous surface, bubbles are easily enclosed between the top layer and the photoresistive layer insulation material is bonded to this surface.

In order to avoid these difficulties in porous photoresistive layers it is not sufficient to press the insulating covering layer on the photoconductive layer by means of a deformable synthetic resin which is free from solvent as is known per se from German Auslegeschrift No. 19 56 166. Although this extra layer of synthetic resin, apart from extra costs of material and labour, already involves a reduction of the sensitivity of the electrophotographic recording material, it is necessary according to German Auslegeschrift No. 19 56 166 for porous photoconductive layers to provide an insulating intermediate layer, the insulating materials of which penetrate into the pores of the photoconductive layer for the greater part. The disadvantage of this is that the porosity of the photoconductive layer is reduced.

One object of the present invention is to provide an electrophotographic recording material of which the layer of photoconductor-binder has a high porosity on which inter alia a large sensitivity to X-ray radiation is based. The formation of an uneven surface and hence bubbles and pleats must simultaneously be avoided.

According to the invention there is provided an electrophotographic recording material having a porous layer of photoconductor-binder which is provided between an electrically conductive layer and a dielectric foil characterised in that the pores of the layer of photoconductor-binder are filled with a high-ohmic dielectric liquid wetting both the layer of photoconductor-binder and the foil.

For the purpose of the present invention high-ohmic dielectric liquids and insulating liquids, respectively, are to be understood to mean liquids having a specific conductivity between $10^{-8}$ and $10^{-16}$ $(\Omega.cm)^{-1}$, especially between $10^{-11}$ and $10^{-13}$ $(\Omega.cm)^{-1}$. Examples of such liquids are hexane, mixtures of isoparaffin with 9 to 13 carbon atoms (for example, Shellsol) and other heavy petrols, metal organic liquids (for example tetramethyl tin), $CCl_4$, $CCl_3Br$, $CH_2I_2$, $CHFI_2$, $CCl_3I$, $CH_2BrI$, $CH_2ClI$, $CH_2RI$ where R is an alkyl group containing from 1 to 13 carbon atoms, $CHCl_2I$ and mixtures thereof. The pores of the layer of photoconductor-binder may be filled with tetramethyl tin. The pores of the layer of photoconductive-binder may alternatively be filled with a dielectric liquid which becomes photoconductive on exposure to X-rays. Further dielectric liquids are stated below.

According to the present invention the recording material is manufactured whereby the dielectric foil and the layer of the photoconductive-binder are laid one on top of the other characterised in that prior to laying the dielectric foil and the layer of photoconductive-binder one on top of the other, the layer of photoconductor-binder is soaked with the dielectric liquid and after laying the foil and the layer one on top of the other any excessive liquid is removed, preferably by being wiped off.

The photoconductors are present, for example, in the form of crystal grains and consist, for example, of inorganic material, especially of cadmium sulphide, cadmium selenide, metallic selenium, zinc oxide, zinc sulphide, selenium telluride, titanium dioxide, lead monoxide or sulphur. The crystal grains preferably consist of tetragonal lead monoxide. This is recommended in particular for electrophotographic applications of the recording material manufactured according to the invention.

The photoconductor crystal grains preferably have a diameter from 1 to 50 μm. A particularly advantageous method of manufacturing a photoconductive layer from tetragonal lead monoxide with the preferably used grain size in a binder is disclosed in German Offenlegungsschrift No. 26 41 018.

The photoconductor crystal grains are dispersed in a solution of the binder, for example, by stirring or grinding. Suitable as binders for the manufacture of the dispersion are, for example, polyacrylic acid esters, polymethacrylic acid esters, vinyl polymers, for example, polystyrene, polyvinyl chloride, polyvinyl acetate and copolymers of these materials, polyesters, alkyde resins and polyphenylene oxide. Alkyde resins are preferably used, especially commercially available products which can be used for the preparation of paint and are available, for example, under the trade names Paralac, Lioptal, Synolac and Alkydal; furthermore polyesters, for example, T 203 (Chemische Werke Witten). Suitable as organic solvents for the binder are, for example, toluene, alcohols and phthalic acid esters liquid at room temperature, methyl ethyl ketone and butanone. The solvent toluene is preferably used for alkyde resins.

The ratios of the quantities in the dispersion are then preferably chosen to be so that the finished layer of photoconductor-binder comprises a quantity of binder of from 0.1 to 10% by weight. This comparatively small part of binder provides a contribution to a high porosity of the layer.

The dispersion of photoconductor crystal grains and binder may be provided in known manner on the electrically conductive layer, for example, by sedimentation, dipping, spraying, while using a spatula or a dip roller. If the dispersion contains tetragonal lead monoxide, the sedimentation method is recommended. The electrically conductive layer consists, for example, of steel, aluminium, copper, brass, also with noble metal coatings, or layers of tin dioxide or indium oxide on glass. Aluminium and alloys thereof are preferably used as materials for the electrically conductive layer.

The provided dispersion is now dried so as to remove at least a part of the solvent, for example, by storage in air or by a thermal treatment. The subsequent soaking with the high-ohmic dielectric liquid is carried out as follows:

(a) pouring the liquid by causing the liquid to drip, for example, centrally on the layer so that it flows towards the edge. As a result of the wetting the whole layer is soaked with the liquid without bubbles.

(b) Spraying the liquid.

The dielectric foil is then laid on the soaked layer of photoconductor-binder. Foils suitable for this purpose consist, for example, of polycarbonate, polyethylene terephthalate, polystyrene or cellulose acetate having resistivities of approximately $10^{12}$ to $10^{18}$ Ohm. cm. Foils of polyethelene terephthalate are preferably used. The dielectric foil preferably has a thickness from 3 to 50 μm in particular from 8 to 20 μm. Providing the foil is carried out by wiping with a soft cloth or by carefully pressing with slight pressure by means of a roller, the excessive liquid being pressed from the centre towards the edge and out of the layer. The layer of photoconductor-binder may not be damaged by applying the foil.

The foil is fixed by the interfacial tension. Thus the adhesion of the dielectric foil to the layer of photoconductor-binder is increased by the dielectric liquid, by which liquid both the layer of photoconductor-binder and the foil are wetted. In contrast with a binder and adhesive, respectively, which fill the pores and the hollow spaces, respectively, between the photoconductor crystal grains and thus as an insulator changes to a decisive extent the electric properties of the layer, the insulating liquid influences the layer of photoconductor-binder at any rate in a positive sense.

The conduction mechanism in the photoconductor-binder may probably be imagined so that a large part of the charge carriers generated, for example, by X-ray radiation, wanders through the volume of the photoconductor crystal grain in an applied electric field. The grain limits form a barrier for this flow of charge carriers which has to be overcome. Many grain limits (so fine powder) result in losses and hence in a smaller sensitivity. Since the charge carriers are mobile in the dielectric liquids used, the contact barrier can be overcome and the charge carriers can also move freely through the dielectric liquid. An extra advantage is if further charge carriers are generated by absorption of X-rays in the dielectric liquid (for example, TMT=tetramethyl tin). As a result of this a larger sensitivity of layers of photoconductor-binder after soaking with a high-ohmic dielectric liquid can be obtained.

During soaking the layer of photoconductor-binder with the liquid there is no danger that the photoconductor crystal gains are pressed apart and hence the contact becomes worse, which easily occurs in the adhesives by shrinkage processes upon hardening.

Since in addition no problems arise with the electric contact of the provided foil with the photoconductor crystal grains upon soaking the layer of photoconductor-binder with the liquid (the charge carriers generated by the radiation must reach the lower side of the foil through the layer because otherwise interfering polarisation charges are formed), the unevennesses of the surface of the layer of photoconductor-binder can be compensated for by the liquid so that a flat surface of the dielectric foil is obtained.

The recording material of the invention does not have the disadvantages of the known systems, for example, of the systems which consist only of a dielectric liquid (German Offenlegungsschrift No. 25 07 147; Radiology 116 (1975) 415); because, due to the large X-ray absorption, for example by lead monoxide, thinner layers may be used with larger sensitivity and thus simultaneously a larger resolving power can be obtained. The material of the invention may be used in known electrophotographic methods (for example, corona charge or charge with a liquid electrode). The charge image is stored on the dielectric foil where it can also be immediately developed.

Since with the material of the invention the foil can easily be removed, the toner transfer which otherwise is necessary (for example, to foil or paper), which transfer always involves difficulties and generally results in reduction of the picture quality, can be avoided. At any rate, the layer of photoconductor-binder must then be soaked again prior to each new coating with a foil or the losses of liquid must be replenished.

The invention will now be described in greater detail with reference to the accompanying drawing and to the following examples.

The sole FIGURE of the drawing shows a multilayer recording material for electrophotography. In the FIGURE, reference numeral 1 is an electrically conductive substratum, for example of aluminium, a noble metal coated steel or glass with conductive layer. On the substratum 1 a soaked layer of photoconductor-binder 2, for example, having lead monoxide as a photoconductor is provided. On top of this a dielectric foil 3, for example of polyethylene terephthalate, is provided.

EXAMPLE 1

A 0.2 mm thick layer of photoconductor-binder having tetragonal lead monoxide powder (average grain diameter approximately 20 μm) as a photoconductor and Paralac (ICI) as a binder provided on a plate of aluminium of approximately 50×50 mm in accordance with Example 4 of the German Offenlegungsschrift No. 26 41 018, is soaked with 5 ml of tetramethyl tin by pouring the liquid centrally on the plate which, while flowing towards the edge, forms a layer which covers the whole plate uniformly. On this layer a 12 μm thick foil of polyethylene terephthalate (Hostaphan) is laid and the excessive liquid is removed by means of a roller press with a slight pressure.

The electrophotographic recording material thus manufactured had a flat surface with readily adhering covering foil. The sensitivity of the recording material was measured by means of a material test tube of the type MOD 151 Be (tungsten anode, peak voltage 140 kV, 440 μm Bi-filter, dose power 50 mR/s, manufacturer: C. H. F. Muller). Because in the blackening measurement of a developed electrophotographic scene the sensitivity of the developer used influences the measured value to a decisive extent, the sensitivity of the electrophotographic recording material of the invention is characterised by that charge density which is generated by absorption of an X-ray dose of $2.58 \cdot 10^{-7}$ C/kg. A voltage of 1500 V is applied to the electrophotographic system via a liquid electrode (plus terminal on the side of the foil).

Good halftone records can be manufactured by means of the material manufactured in the above-described manner. The resolving power is 10 line pairs per mm with a generated charge density of $4 \cdot 10^{-5}$ C/m$^2$.

EXAMPLE 2

A layer of PbO binder manufactured in a manner analogous to that of Example 1 is soaked with 5 ml of hexane and covered with a 12 μm thick polyethylene terephthalate foil. The excessive liquid is removed by wiping from the centre towards the edges by means of a soft cloth. With the electrophotographic testing method as described in Example 1 a charge density of $2 \cdot 10^{-5}$ C/m$^2$ is obtained.

EXAMPLE 3

A layer of PbO binder of very fine-granular PbO crystal powder (1 μm) is manufactured by means of a method analogous to that of Example 1. Without soaking, such layers have an approximately 6 times smaller sensitivity than layers having an average grain diameter of 20 μm. After soaking with tetramethyl tin a charge density of $10^{-5}$ C/m$^2$ is obtained.

What is claimed is

1. An electrophotographic recording material comprising:

a layer of electrically conductive material;

a dielectric foil;

a porous layer comprising a photoconductive material in a binder, disposed between the layer of conductive material and the foil;

a high-ohmic dielectric liquid which wets both the porous layer and the foil and which fills the pores of the porous layer.

2. A recording material as claimed in claim 1 wherein the dielectric liquid comprises tetramethyl tin.

3. A recording material as claimed in claim 1 wherein the dielectric liquid comprises a liquid which becomes photoconductive upon exposure to X-rays.

4. A recording material as claimed in claims 1, 2 or 3 wherein the porous layer comprises crystal grains of tetragonal lead monoxide.

5. A recording material as claimed in claim 1 wherein the porous layer comprises photoconductor crystals having a diameter of from 1 to 50 μm.

6. A recording material as claimed in claim 4 wherein the porous layer comprises photoconductor crystals having a diameter of from 1 to 50 μm.

7. A recording material as claimed in claims 1, 2, 3, or 5 wherein the porous layer comprises from 0.1% to 10% (by weight) of binder.

8. A recording material as claimed in claim 4 wherein the porous layer comprises from 0.1% to 10% (by weight) binder.

9. A recording material as claimed in claim 6 wherein the porous layer comprises from 0.1% to 10% (by weight) binder.

10. A method of manufacturing the recording material claimed in claims 1, 2, 3, or 5 comprising the steps of sequentially:

soaking the porous layer with the dielectric liquid;

laying the dielectric foil on top of the porous layer; and removing excess liquid from the foil and porous layer.

11. A method of manufacturing the recording material claimed in claim 4 comprising the steps of sequentially:

soaking the porous layer with the dielectric liquid;

laying the dielectric foil on top of the porous layer; and removing excess liquid from the foil and porous layer.

12. A method of manufacturing the recording material claimed in claim 6 comprising the steps of sequentially:

soaking the porous layer with the dielectric liquid;

laying the dielectric foil on top of the porous layer; and removing excess liquid from the foil and porous layer.

13. A method of manufacturing the recording material claimed in claim 7 comprising the steps of sequentially:

soaking the porous layer with the dielectric liquid;

laying the dielectric foil on top of the porous layer; and removing excess liquid from the foil and porous layer.

14. A method of manufacturing the recording material claimed in claim 8 comprising the steps of sequentially:

soaking the porous layer with the dielectric liquid;

laying the dielectric foil on top of the porous layer; and removing excess liquid from the foil and porous layer.

15. A method of manufacturing the recording material claimed in claim 9 comprising the steps of sequentially:

soaking the porous layer with the dielectric liquid;

laying the dielectric foil on top of the porous layer; and removing excess liquid from the foil and porous layer.

* * * * *